US006468094B2

(12) United States Patent
Kuo

(10) Patent No.: US 6,468,094 B2
(45) Date of Patent: Oct. 22, 2002

(54) ELECTRICAL CONNECTOR FOR INSERTION OF ELECTRONIC CARD

(75) Inventor: Ming Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/017,946

(22) Filed: Dec. 12, 2001

(65) Prior Publication Data

US 2002/0072260 A1 Jun. 13, 2002

(30) Foreign Application Priority Data

Dec. 12, 2000 (TW) ..... 89221518

(51) Int. Cl.[7] ..... H01R 4/66

(52) U.S. Cl. ..... 439/108; 439/607; 439/566; 439/570

(58) Field of Search ..... 439/108, 607–610, 439/566–573, 352

(56) References Cited

U.S. PATENT DOCUMENTS 5,288,247 A * 2/1994 Kaufman ..... 439/607
5,533,908 A * 7/1996 Henry et al. ..... 439/352
6,019,633 A * 2/2000 Tung et al. ..... 439/570
6,129,562 A * 10/2000 Hong ..... 439/607

* cited by examiner

*Primary Examiner*—Hien Vu
(74) *Attorney, Agent, or Firm*—Wei Te Chung

(57) ABSTRACT

An electrical connector (1) for insertion of an electronic card comprises an insulating housing (10), a plurality of contacts (20) secured to the housing, a shield (30) enclosing a top surface (10*a*) of the housing and a pair of grounding plates (40) assembled to the housing. The housing defines a receiving slot (18) and a locking slot (19) at the top surface. The grounding plates comprise base portions (42), mating portions (44) extending from bottom edges of the base portions for being soldered to a motherboard, and locking portions (46) extending from top edges of the base portions. The locking portion include hooks (46*b*) at free ends thereof retained within the locking slots and necks (46*a*) between the hooks and the base portions for pressing the top surface of the housing, thereby preventing disengagement between the housing and the grounding plate.

4 Claims, 9 Drawing Sheets

ELECTRICAL CONNECTOR FOR INSERTION OF ELECTRONIC CARD

BACKGROUND OF THE INVENTION

1. Field of the Invention

The present invention relates to an electrical connector for insertion of an electronic card, and particularly to an electrical connector having grounding plates soldered to a motherboard.

2. Description of Related Art

FIGS. 6 through 9 disclose a conventional electrical connector soldered to a motherboard 200 for insertion of an electronic card (not shown) thereby establishing electrical connection between the motherboard 200 and the electronic card. The connector comprises an insulating housing 80, a metal shield 90 and a pair of grounding plates 100. The grounding plates 100 comprise base portions 102 engaged to the housing 80, mating portions 104 to be soldered to the motherboard 200, and contact portions 106 extending from side edges of the base portions 102. The base portions 102 form a plurality of protrusions 102*a* at two opposite sides thereof engaged to inner walls of receiving slots 84 (see FIGS. 8 and 9) defined in the housing 80, thereby securing the housing 80 to the motherboard 200. However, the engagement between the grounding plates 100 and the housing 80 is not reliable because the inner walls of the receiving slots 84 are apt to be pierced by the protrusions 102*a* of the grounding plates 100, causing the housing 80 to separate from the motherboard 200 when the housing is applied a large upward force.

SUMMARY OF THE INVENTION

Accordingly, the object of the present invention is to provide an electrical connector having a pair of grounding plates for reliably securing an insulating housing of the connector to a motherboard.

In order to achieve the object set forth, an electrical connector of the present invention comprises an insulating housing, a plurality of contacts secured to the housing, a shield shielding a top surface of the housing, and a pair of grounding plates assembled at two opposite sides of the housing. The housing defines receiving slots and locking slots at the top surface thereof. The grounding plates comprise base portions retained with the receiving slots of the housing, mating portions soldered to a motherboard, and locking portions secured in the locking slots of the housing to prevent the housing from disengaging with the motherboard.

Other objects, advantages and novel features of the invention will become more apparent from the following detailed description of the preferred embodiment when taken in conjunction with the accompanying drawings.

DETAILED DESCRIPTION OF THE INVENTION

Figure 1:
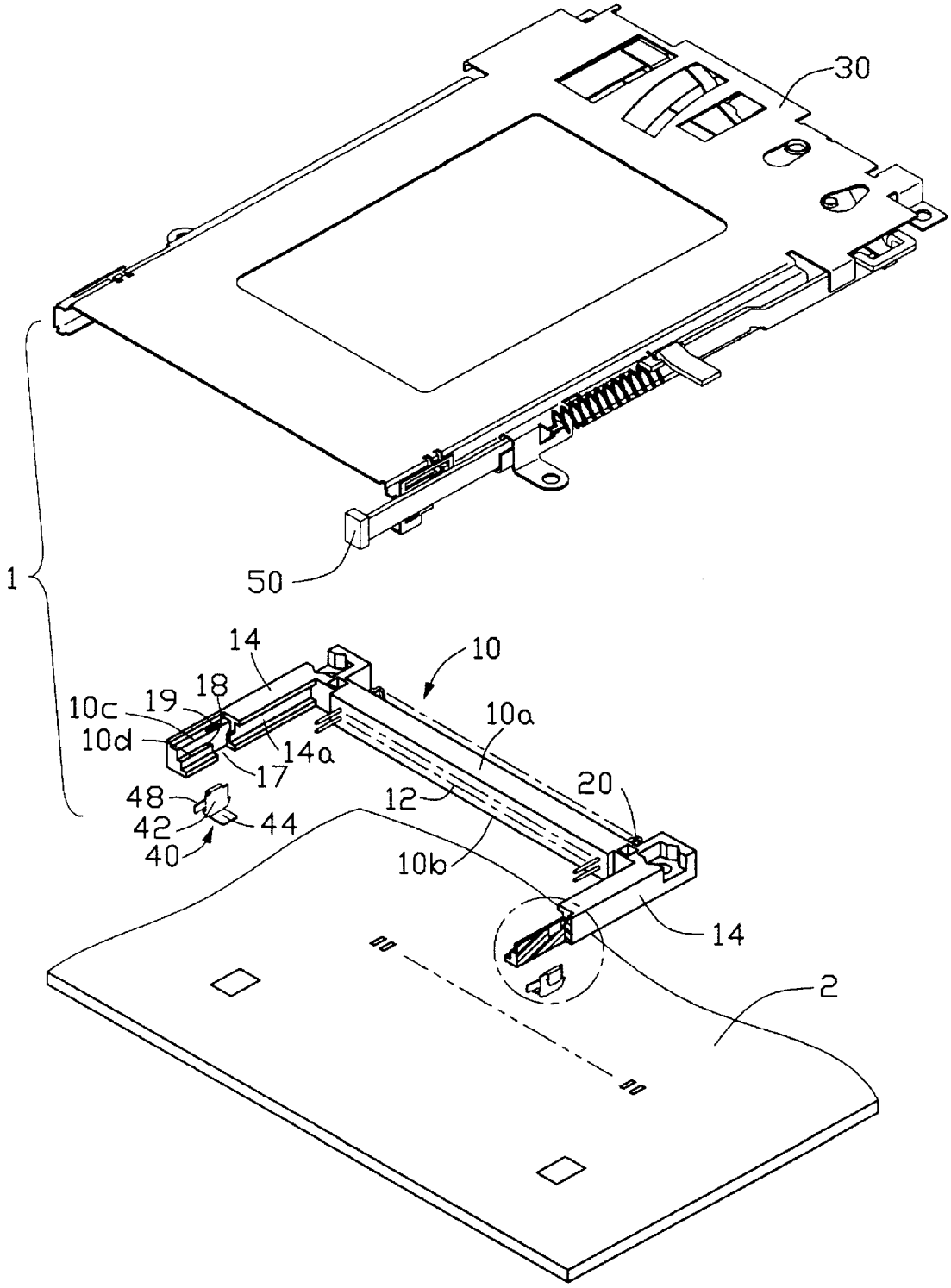
FIG. 1 is an exploded view of an electrical connector of the present invention and a motherboard wherein the housing is partially cut to show locking slots thereof.

Reference will now be made to the drawing figures to describe the present invention in detail.

Figure 2:
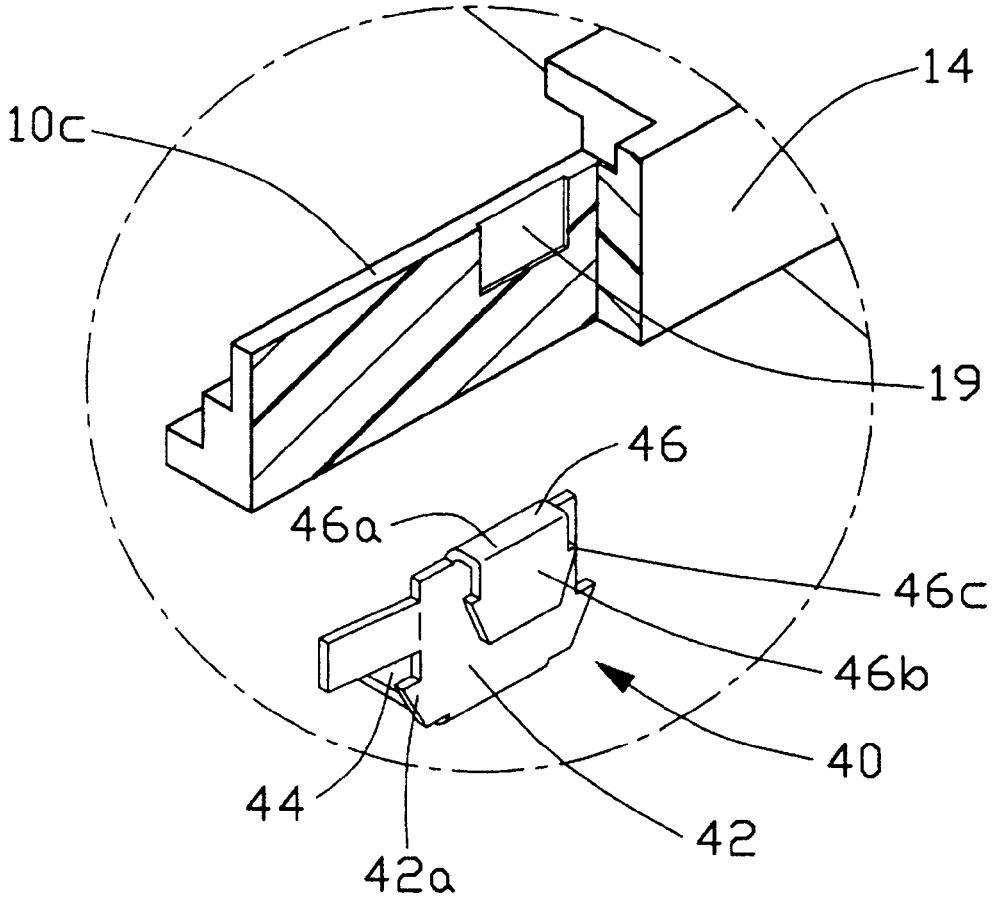
FIG. 2 is an enlarged view of the circled structures in FIG. 1.

Referring to FIGS. 1 and 2, an electrical connector 1 of the present invention comprises an insulating housing 10, a plurality of contacts 20 secured to the housing 10, a shield 30 shielding the housing 10, and a pair of grounding plates 40 engaged to the housing 10 for securing the housing 10 to a motherboard 2.

The housing 10 has a top surface 10*a* and a bottom surface 10*b* opposite to the top surface 10*a* thereof. The housing 10 comprises an elongated body 12 and two side arms 14 perpendicularly extending from two opposite ends of the body 12. The side arms 14 define card receiving slots 14*a* at inner surfaces thereof for receiving an inserted electronic card (not shown). The side arms 14 define first depressed surfaces 10*c* at free ends thereof stepped with the top surfaces 10*a* of the housing 10, and locking slots 19 in the first depressed surfaces 10*c* thereof. The side arms 14 define second depressed surfaces 10*d* at the free ends thereof stepped with the first depressed surfaces 10*c* of the housing 10, and receiving slots 18 at the second depressed surfaces 10*d* thereof. The side arms 14 further define recesses 17 incommunicating with the receiving slots 18 and the bottom surface 10*b* of the housing 10.

The grounding plates 40 comprise flat base portions 42 retained within the receiving slots 18 of the housing 10, mating portions 44 perpendicularly extending from bottom edges of the base portions 42, and locking portions 46 extending from top edges of the base portions 42. The base portions 42 include a plurality of protrusions 42*a* at two opposite sides thereof. The mating portions 44 have square configuration adapted for being soldered to the motherboard 2. The locking portions 46 include hooks 46*b* at free ends thereof and necks 46*a* between the hooks 46*b* and the base portions 42. The hooks 46*b* include protrusions 46*c* at two opposite sides of free ends thereof. The grounding plates 40 further form contact portions 48 at side edges of the base portions 42.

Figure 3:
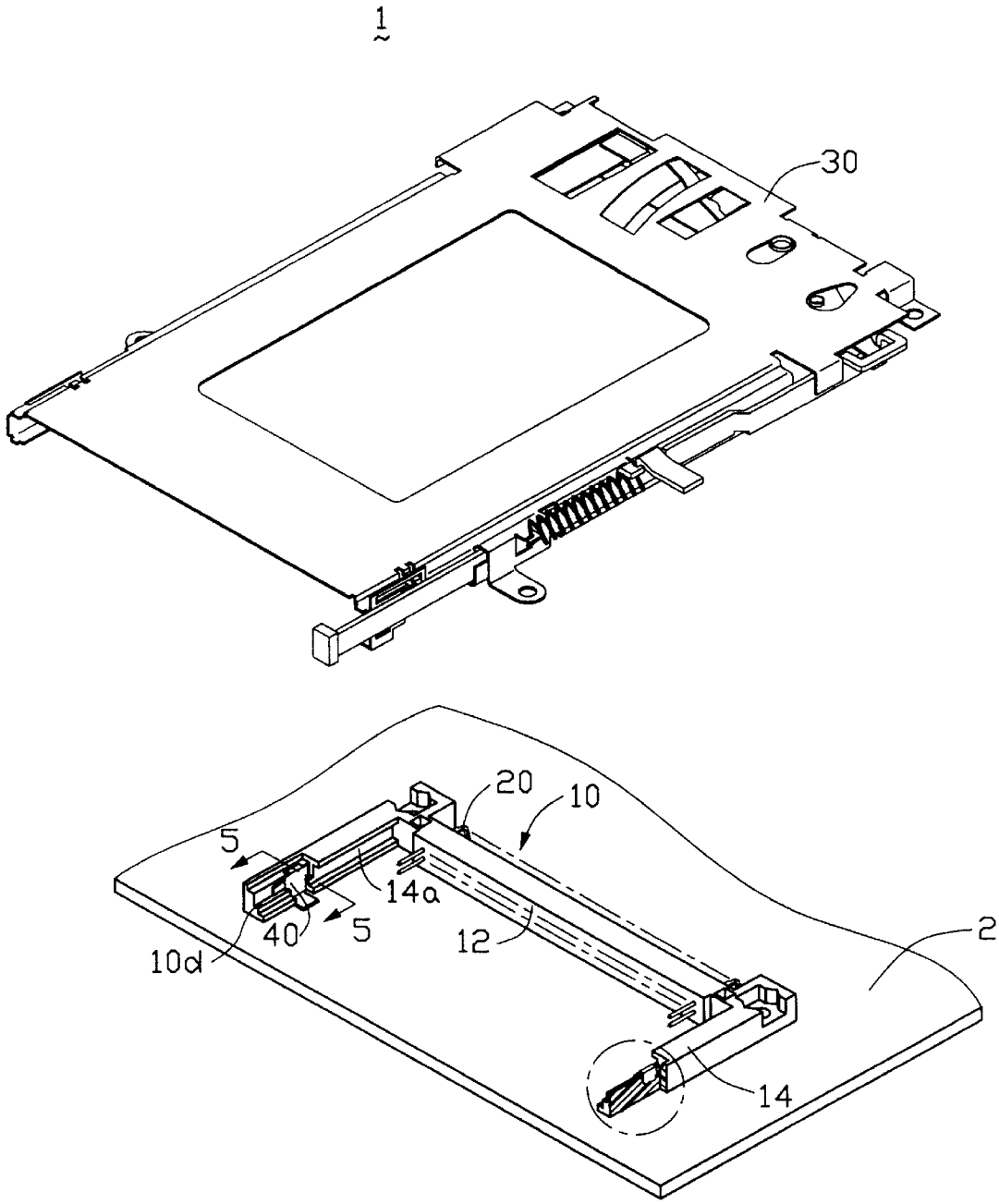
FIG. 3 is a non-fully assembled view of FIG. 1 wherein the housing is partially cut to show the locking slots thereof.
Figure 4:
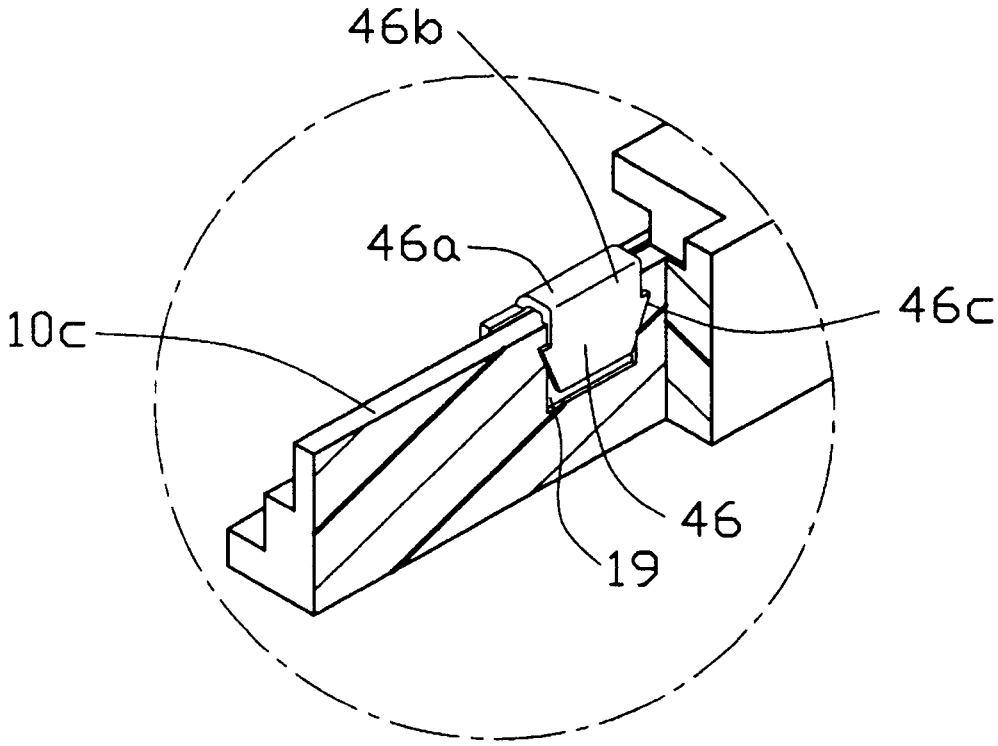
FIG. 4 is an enlarged view of the circled structures in FIG. 3.
Figure 5:
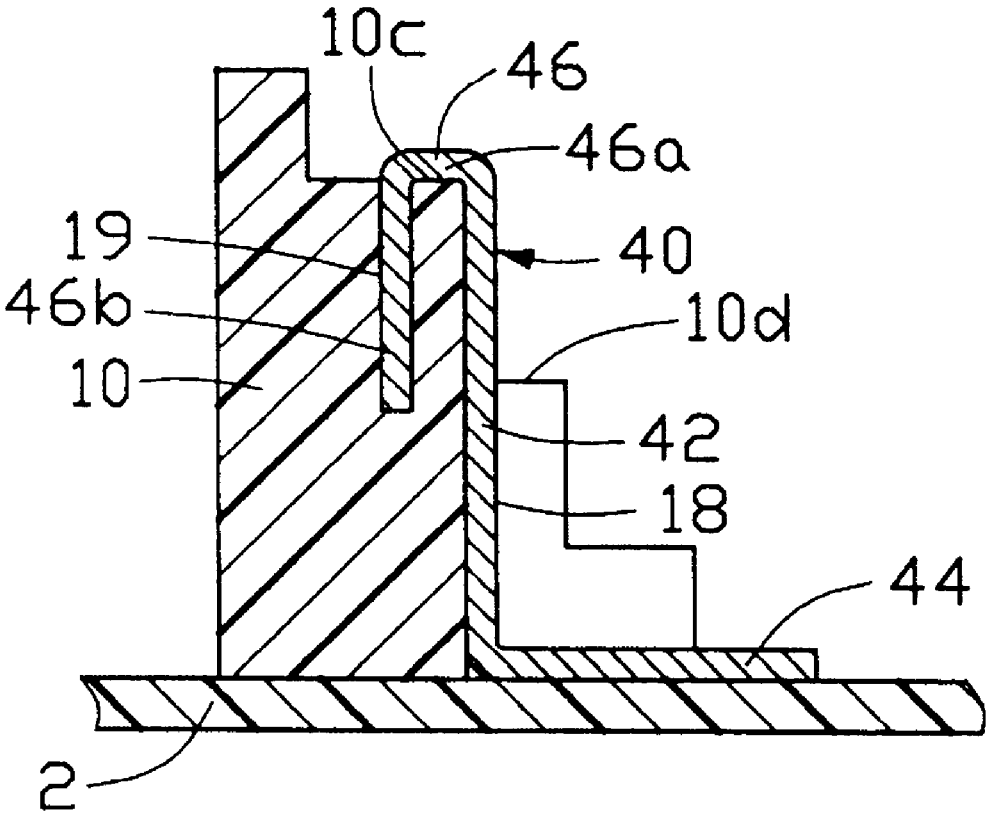
FIG. 5 is a cross-sectional view of FIG. 4 along line 5—5.
Figure 6:
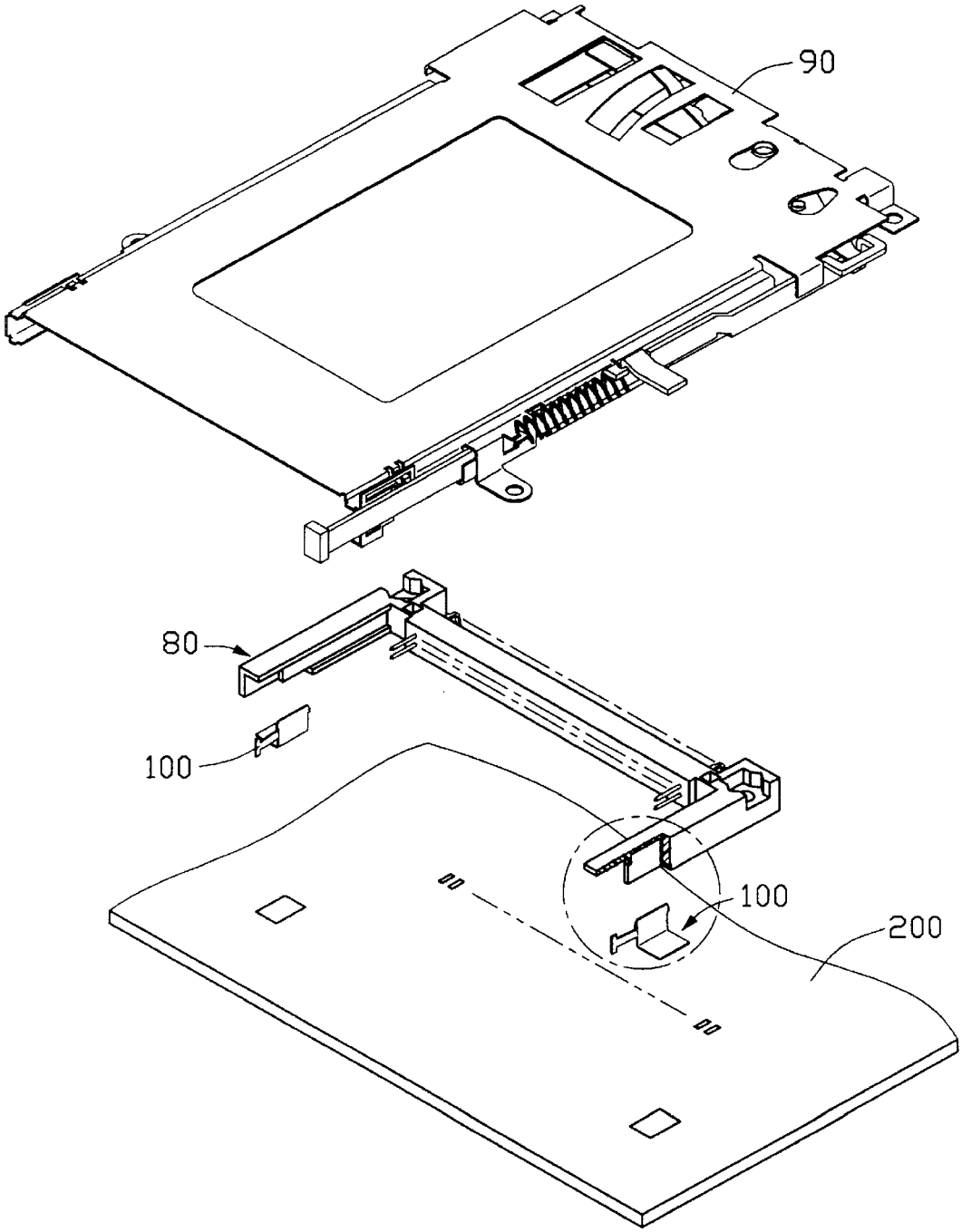
FIG. 6 (PRIOR ART)
FIG. 6 is an exploded view of a conventional electrical connector wherein the housing is partially cut to show locking slots thereof.
Figure 7:
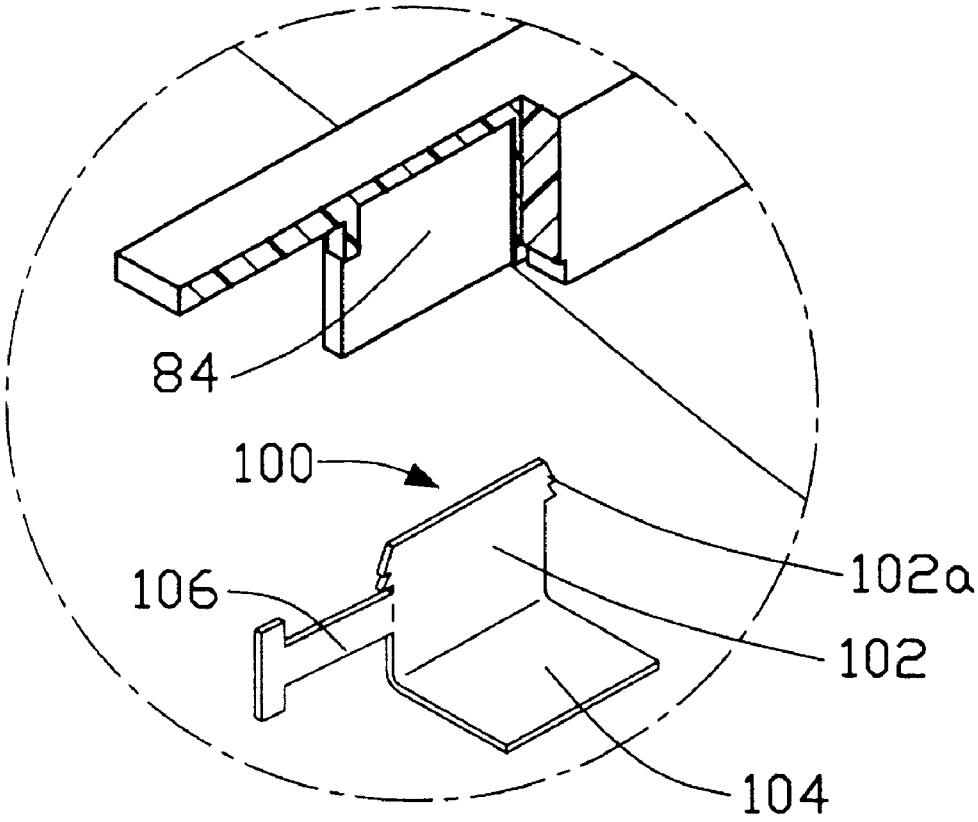
FIG. 7 (PRIOR ART)
FIG. 7 is an enlarged view of the circled structures in FIG. 6.
Figure 8:
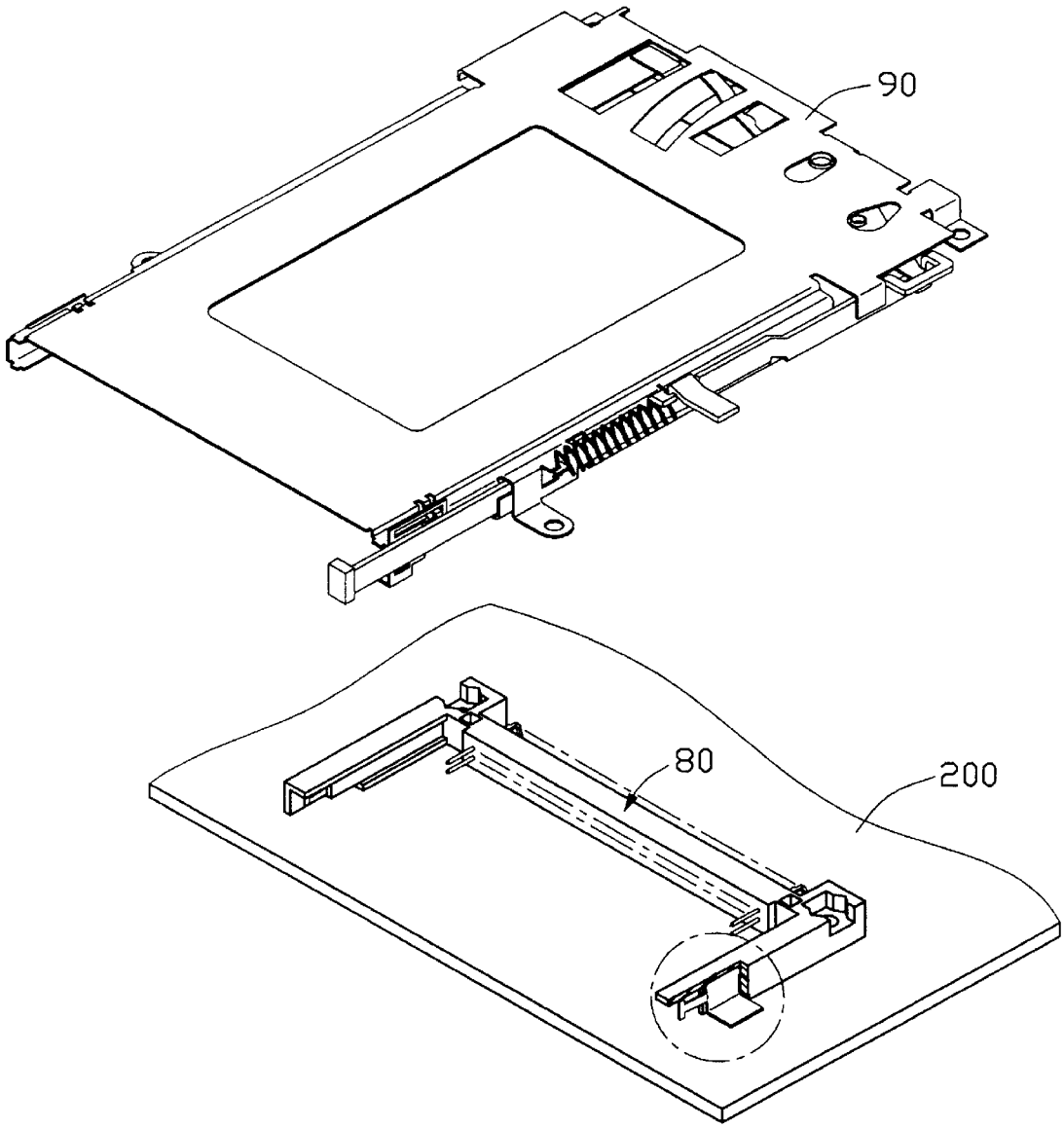
FIG. 8 (PRIOR ART)
FIG. 8 is a non-fully assembled view of FIG. 6 wherein the housing is partially cut to show the locking slots thereof.
Figure 9:
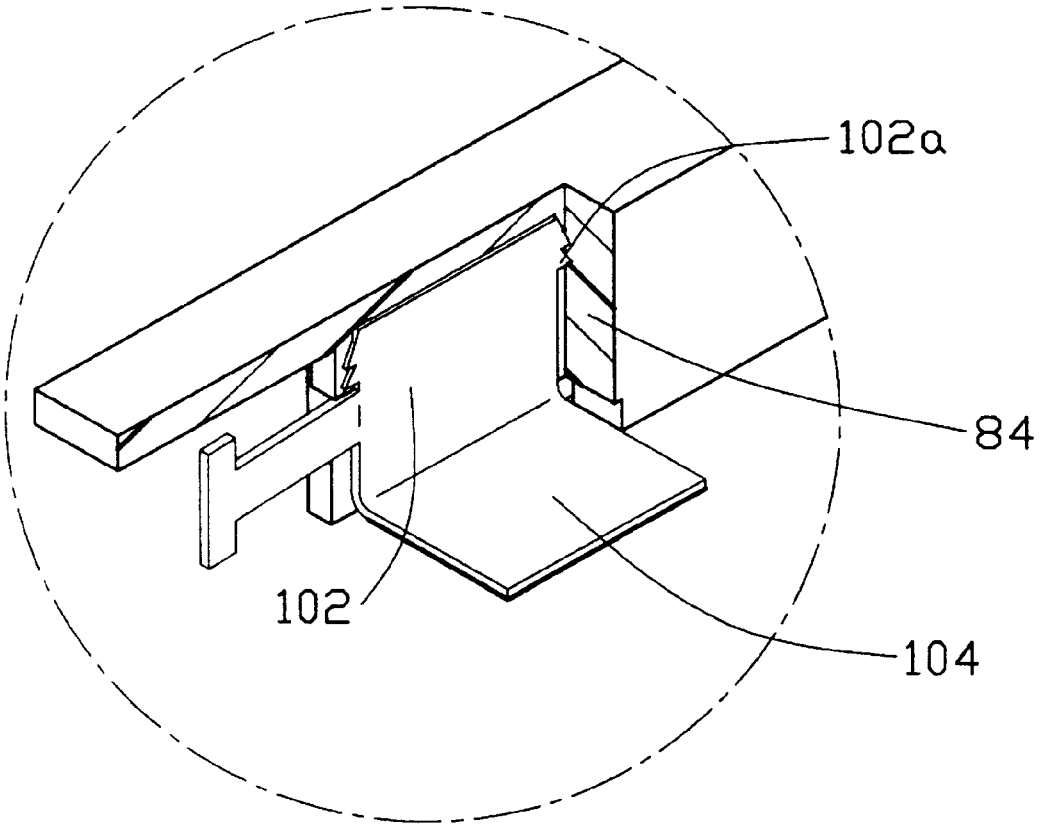
FIG. 9 (PRIOR ART)
FIG. 9 is an enlarged view of the circled structures in FIG. 8.

Referring to FIGS. 3–5, in assembly, the grounding plates 40 are downwardly assembled to the side arms 14 of the housing 10, wherein the base portions 42 are retained within the receiving slots 18 by the protrusions 42*a* engaging to inner walls (now labeled) of the receiving slots 18. The mating portions 44 of the grounding plates 40 extend through the recesses 17 and being soldered to the motherboard 2. The hooks 46*b* of the grounding plates 40 hooking in the locking slots 19 of the housing 10 by the protrusions 46*c* engaging to inner walls of the locking slots 19. The necks 46*a* tightly press at the first depressed surfaces 10*c* of the housing 10.

An advantage of the present invention is that the hooks 46*b* of the locking portions 46 are securely retained in the locking slots 19 of the housing 10 and the necks 46*a* tightly pressing at the first depressed surfaces 10*c* of the housing 10, thereby preventing the housing 10 from disengaging with the motherboard 2 when the housing 10 is applied a large upward force remote from the motherboard 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting an electronic card to a motherboard, comprising:

an insulative housing defining an elongated body with a pair of side arms extending at two opposite ends thereof, each of said side arms defining a card receiving slot and a locking slot therein;

a plurality of contacts secured to the housing;

a metal shield shielding the top of the housing; and a pair of grounding plates having base portions engaged to the housing, mating portions connecting with the base portions and adapted to be soldered to the motherboard, and locking portions engaged to the locking slots of the housing to force the housing downward the motherboard; wherein each side arm defines a first depressed surface at a free end thereof stepped with the top surface thereof, the locking slots being defined at the first depressed surface; wherein each side arm defines a second depressed surface at the free end thereof stepped with the first depressed surface and closer to a bottom surface thereof relative to the first depressed surface, and a receiving slot formed in an inner face of each of said side arms and interrupt the corresponding card receiving slot at the second depressed surface thereof parallel to a corresponding locking slot, the receiving slot receiving the base portion of one of the pair of grounding plates; wherein the locking portions of the grounding plates include hooks at free ends thereof retained within the locking slots of the housing, and necks between the hooks and the base portions for tightly pressing at the first depressed surfaces of the housing; wherein the hook of the grounding plates define a plurality of protrusions at two opposite sides thereof engaged to inner walls of the locking slots of the housing.

2. The electrical connector as claimed in claim 1, wherein the base portions of the grounding plates define a plurality of protrusions engaged to inner walls of the receiving slots of the housing.

3. An electrical connector comprising:

an insulative housing defining an elongated body with a pair of side arms extending at two opposite ends thereof, each of said side arms defining a card receiving slot and a locking slot therein;

a plurality of contacts disposed in the elongated body;

a receiving slot formed in an inner face of each of said side arms and interrupting the corresponding card receiving slot;

a locking slot formed in the corresponding side arm laterally spaced from the corresponding receiving slot; and a metallic grounding plate including a vertical flat base portion received within the receiving slot, a mating portion horizontally extending from a bottom edge of said base portion toward the other of said side arms, a locking portion extending from an upper edge of the base portion and latched within the locking slot; wherein said base portion and said mating portion together define an L-shaped configuration directly facing the corresponding card receiving slot; wherein the locking portions of the grounding plates include hooks at free ends thereof retained within the locking slots of the housing; wherein the hook of the grounding plates define a plurality of protrusions at two opposite sides thereof engaged to inner walls of the locking slots of the housing.

4. The connector as claimed in claim 3, wherein said locking portion is downwardly assembled to the corresponding side arm.

* * * * *